United States Patent [19]

Joner et al.

[11] Patent Number: 4,633,778

[45] Date of Patent: Jan. 6, 1987

[54] SURFACE MINELAYING SYSTEM FOR CRAFT OF OPPORTUNITY

[75] Inventors: Bruno A. Joner; John W. Williams, both of Bellevue, Wash.

[73] Assignee: The Boeing Company, Seattle, Wash.

[21] Appl. No.: 688,686

[22] Filed: Jan. 3, 1985

[51] Int. Cl.[4] ..... F42B 22/10

[52] U.S. Cl. ..... 102/411; 102/415; 89/1.11

[58] Field of Search ..... 102/411–415; 89/1.11, 1.1; 114/366, 238

[56] References Cited

U.S. PATENT DOCUMENTS

| | | | |
|---|---|---|---|
| 1,183,695 | 5/1916 | Techel | 102/411 |
| 1,228,755 | 6/1917 | Fungo-Giera | 102/413 |
| 1,319,565 | 10/1919 | Burney | 102/413 |
| 2,856,849 | 10/1958 | Ernest | 102/413 |
| 3,626,804 | 12/1971 | Paramythioti | 89/1.11 |
| 4,273,050 | 6/1981 | Brown | 102/411 X |
| 4,301,734 | 11/1981 | Peregrim et al. | 102/413 |
| 4,313,381 | 2/1982 | Tolliver et al. | 102/414 X |

*Primary Examiner*—Peter A. Nelson

*Attorney, Agent, or Firm*—Christensen, O'Connor, Johnson & Kindness

[57] ABSTRACT

A surface minelaying system that can be built up of ganged modules and rapidly mounted on any ship whose displacement permits it to carry mines in some quantity. This minelaying system is a modularized overhead conveyor system that can securely store heavy mines and safely release them overboard at short, predetermined intervals, even in high sea states. The system comprises a frame member, with first and second ends, that defines the longitudinal axis of the minelaying system. The frame member is preferably made up of a rail track braced by periodically spaced vertical and transverse connecting members. Mounting supports are provided for mounting the frame member to the ship. A drive roller and an idler roller are disposed in the first and second ends of the frame member; and an endless drive member is looped about the rollers. A drive means is operatively coupled to the drive roller. A plurality of carrier assemblies with grasping members for selectively grasping a mine are engaged at spaced locations to the endless drive member. The carrier assemblies have wheels that roll and are retained within the rail track. Mines are loaded and stored on the system and, when moved outboard the hull, released into the water. Alternative mechanisms are provided for releasing each mine at a predetermined point as the mine is translated beneath the frame member. In one embodiment, the mines are automatically disengaged from the carriers. The empty carrier assemblies are then moved by the endless drive member through a vertical turnaround in a looped rail system for an inverted overhead return to a loading site near the opposite end of the frame member. In another embodiment each mine is attached to an expendable carrier that is deployed along with the released mine.

18 Claims, 19 Drawing Figures

SURFACE MINELAYING SYSTEM FOR CRAFT OF OPPORTUNITY

BACKGROUND OF THE INVENTION

The laying of mines in sea lanes and harbors can efficiently restrict and control hostile marine traffic during wartime. At the outbreak of hostilities, it may be very important to quickly secure control of ports, approach channels, and sea lanes of communication. This may require the use of craft of opportunity to reinforce and supplement a navy's fleet of regular minelaying platforms. A craft of opportunity (hereinafter referred to as "ship") can be any ship whose displacement permits it to carry mines in some quantity—that requirement being satisfied, a craft of opportunity can be any ship, military or civilian, slow or fast, large or small, with or without, or with very limited deck space available for the stowage and handling of mines.

Sea mines are quite heavy—some exceed 2,000 lb in weight—and they are typically configured like aircraft bombs. Such massive, rounded devices are quite difficult to handle on an unstable, rolling ship deck, especially in high seas. For safety reasons it has therefore been found desirable to mechanize the mine handling and drop. Minelaying rail systems, in which mines are cradled on wheeled undercarriages that roll in tracks mounted on the deck, have been employed. See. U.S. Pat. No. 1,183,695. Such systems succeeded in reducing the amount of manhandling required to lay the mines but were not altogether successful solutions: Slow and complicated tie-down systems were required to cradle and stabilize the mines in high sea states; furthermore, the high tie-down forces increased friction, requiring high forces to move the mines when fully secured.

Moreover, the minelaying systems of the prior art could not be easily adapted to different ships, especially to ships without ample deck space. They could not automatically release mines at short intervals at both low and high ship speeds, especially in rough sea states of, e.g., 3 through 5. They generally could not accept aircraft configured mines without modification to or special equipment for the mine. Furthermore, the minelaying systems of the prior art generally did not positively secure the mines from single-point loading until release, which would minimize the hazard to human loaders and operators.

BRIEF DESCRIPTION OF THE INVENTION

The surface minelaying system constructed in accordance with the present invention is a modularized overhead conveyor system that can be built up of ganged modules and rapidly mounted on any ship whose displacement permits it to carry mines in some quantity. This minelaying system can securely store heavy mines and safely release them overboard at short, predetermined intervals, even in high seas. The system comprises a frame member, with first and second ends, that defines the longitudinal axis of the minelaying system. The frame member is preferably made up of a rail track braced by periodically spaced vertical and transverse connecting members. Mounting supports are provided for mounting the frame member to the ship. A drive roller and an idler roller are disposed in the first and second ends of the frame member, and an endless drive member is looped about the rollers. A remotely controlled power drive is operatively coupled to the drive roller. A plurality of carrier assemblies with grasping members for selectively grasping a mine are engaged at spaced locations to the endless drive member. The carrier assemblies have wheels that roll and are retained within the rail track. Mines are loaded and stored on the system and, when moved outboard the hull, released into the water. Alternative mechanisms are provided for releasing each mine at a predetermined point as the mine is translated beneath the frame member. In one embodiment, the mines are automatically disengaged from the carriers. The empty carrier assemblies are then moved by the endless drive member through a vertical turnaround in a looped rail system for an inverted overhead return to a loading site near the inboard end of the frame member. In another embodiment each mine is attached to an expendable carrier that is deployed along with the released mine.

This minelaying system is a modularized device that is adaptable to any craft of opportunity: only the mounting supports need be adapted to fit the system to the specific configuration of each ship. Universal mounting surfaces on the frame member permit the minelaying system to be installed in different ways: on legs from a deck, from overhead hangers, or from either side for mounting outside the gunwales. This automated, motorized system maintains the mines under positive control during remotely controlled storage, transit, and release.

BRIEF DESCRIPTION OF THE DRAWINGS

FIG. 20 is a side elevation view of the terminal portion of another embodiment wherein mines attached to expendable carriers are carried parallel to one another and transverse to the longitudinal axis of the system;

FIG. 21 is a rear view of the system shown in FIG. 20; and

FIG. 22 is a plan view of the system shown in FIG. 20 with the top plate partially broken away.

DETAILED DESCRIPTION OF THE INVENTION

The surface minelaying system of the present invention can be analogized to a series of simulated aircraft bomb racks in a modularized overhead rail system. Mines are stored in the system, translated outboard the ship's hull, and then released from the system. It is a universal system that is adaptable to numerous ship configurations: the system features universal mounting surfaces, and so only the mounting supports need be varied to mount the system to the available ship. Safety is assured because the mines are securely locked on the system from the time and place of loading to the time and place of release overboard. Manhandling of the mines during transit to the point of drop and during the drop itself has been eliminated by using a remotely controlled powered drive. Thus, minelaying can be accomplished in sea states higher than 3. Also, minelaying can be accomplished at high ship speeds with close spacing of the mines without imperiling the ship's integrity and the crew's safety.

Figure 1:
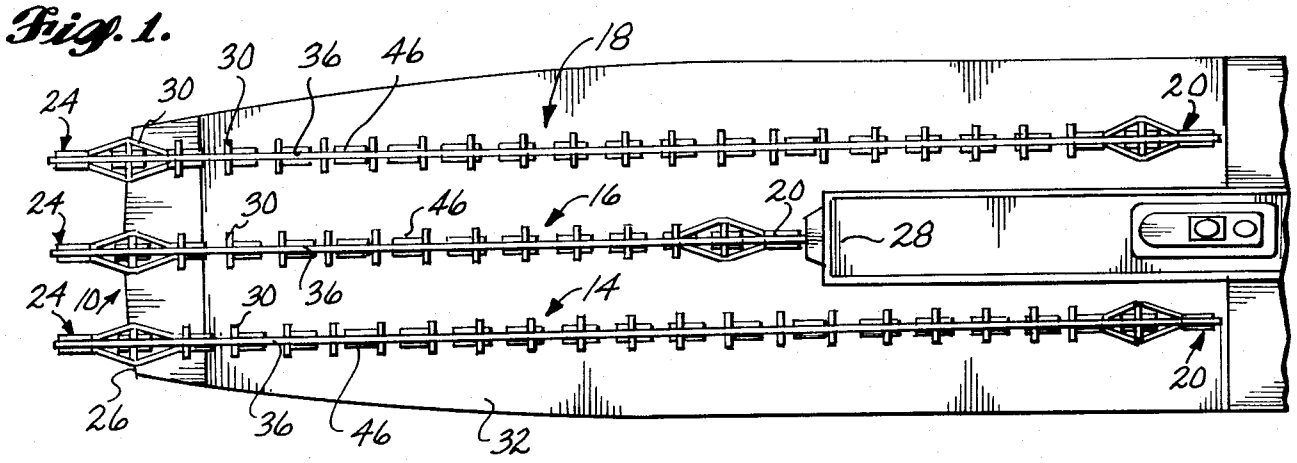
FIG. 1 is a plan view of the stern of a ship equipped with three minelaying systems of the present invention.
Figure 2:
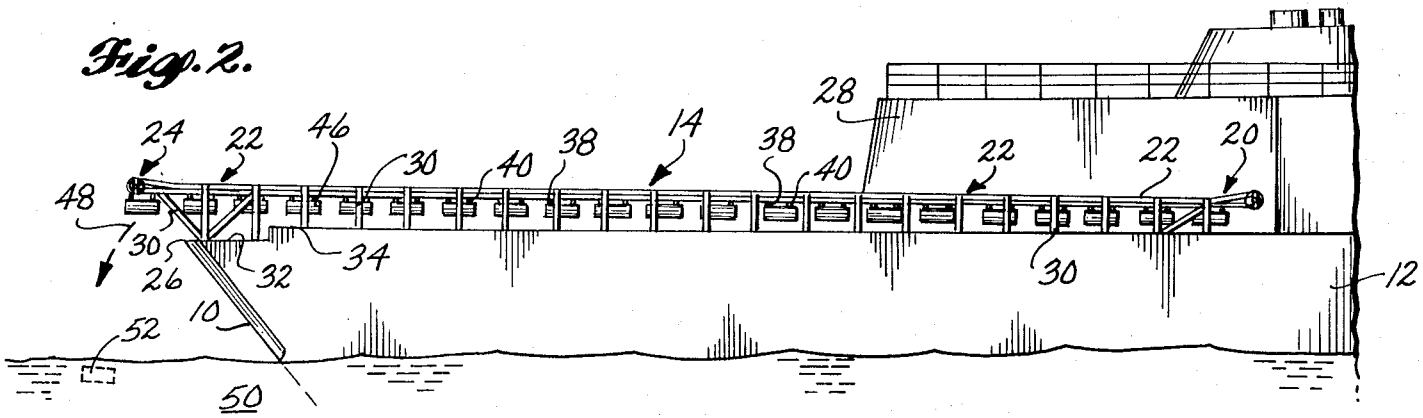
FIG. 2 is a side view of the aft section of the ship in FIG. 1.
Figure 3:
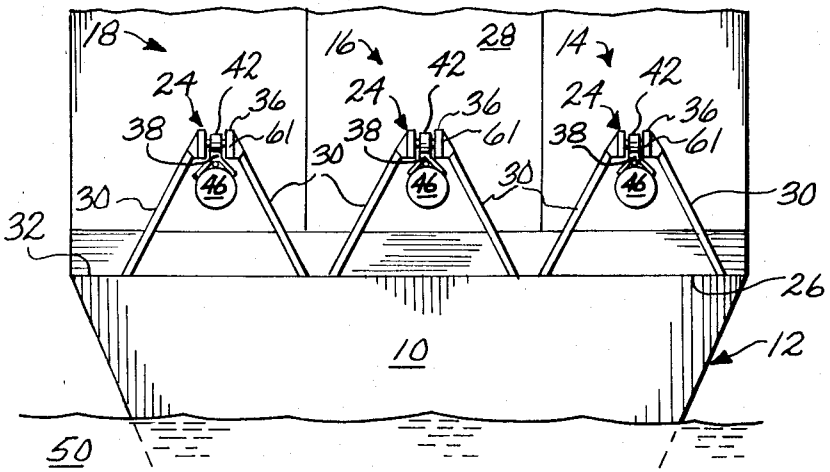
FIG. 3 is a slightly enlarged rear view of the stern of the ship in FIG. 1.

Referring now to FIGS. 1, 2 and 3, an embodiment is shown wherein the stern portion 10 of a ship 12 carries three minelaying systems 14, 16, 18 constructed in accordance with the present invention, i.e., a starboard system 14, a central system 16, and a port system 18. Each of the systems 14, 16, 18 is made up of a plurality of modular units 20, 22, 24 that are arranged in longitudinal array stretching from approximately the center of the ship 12 toward the stern 10 and extending over the transom 26. Two basic types of modular units are employed: an end unit 20, 24 and a middle unit 22. Taking for example the starboard minelaying system 14, an inboard end unit 20 is located at the forward end of the system, and a plurality of middle units 22 that are coupled together extend rearwardly from the inboard end unit 20; the ganged middle units 22 terminate with an outboard end unit 24 that extends beyond the transom 26. The central and port minelaying systems 16, 18 are arranged in a similar manner. Note however, that the three systems 14, 16, 18 are not all the same length. The obstructing superstructure 28 of this ship 12 has been accommodated by assembling the central system 16 from two end units 20, 24 and a plurality, e.g., thirteen in this embodiment, of middle units 22. The starboard and port systems 14, 16 have been positioned on either side of the superstructure 28 and assembled from a pair of end units 20, 24 and, e.g., twenty middle units 22 apiece.

In this embodiment each minelaying system 14, 16, 18 is supported by a framework of stanchions 30 that extend upwardly from the deck 32. For purposes of illustration a pair of stanchions 30 is shown at each junction where the abutting modular units 20, 22, 24 are mechanically coupled together. Due to the lightweight construction of the modular units 20, 22, 24, as described below, a lesser number of supporting members 30 can be employed for many installations. The stanchions 30 are of sufficient height to provide clearance over the deck 32 and fixed deck equipment 34. As discussed below, the minelaying systems can alternatively be supported from vertical superstructure, from overhead structure, or from the gunwales for an outboard installation.

Figure 5:
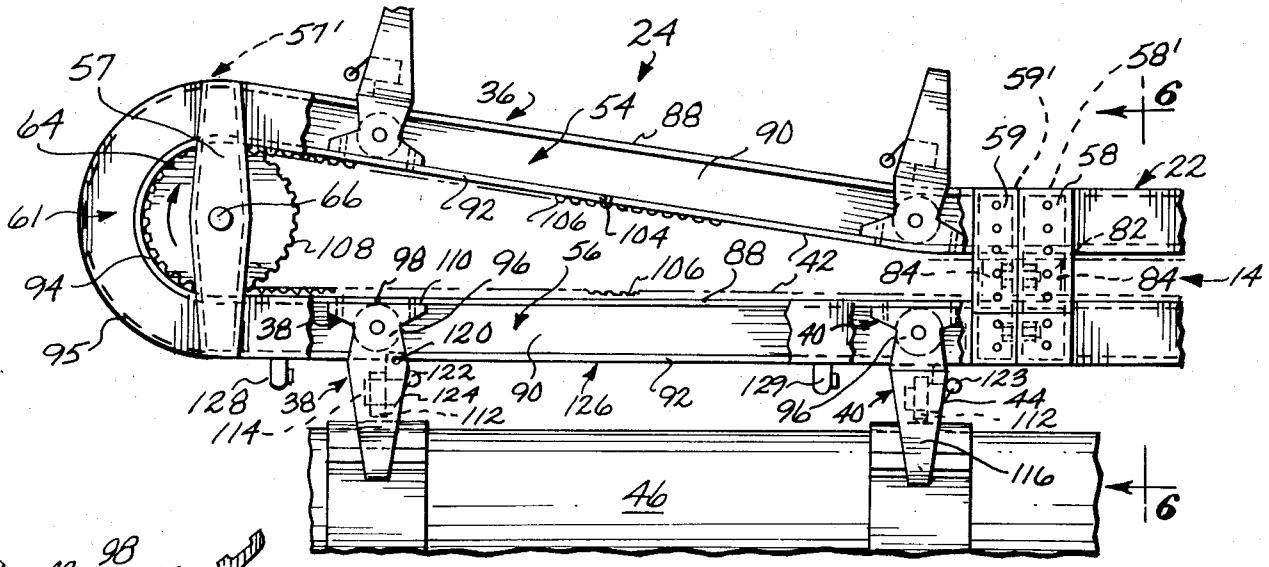
FIG. 5 is an enlarged view of the modular end section of the minelaying system shown in FIG. 4.

The assembled and mounted minelaying system 14 includes an endless track system 36 that houses the wheels, not shown in these views, of a plurality of paired carrier units 38, 40 (indicated in FIG. 2 and shown more clearly in FIG. 5). The carrier units 38, 40 are linked at spaced intervals to an endless drive member 42, not shown in FIG. 2, which has a path of travel coincident with that of the endless track system 36. A grasping member, not detailed in these views, depends from each of the carrier units 38, 40. In the embodiment shown in FIG. 2 a mine 46 can be engaged with the grasping members on the paired carrier units 38, 40. Thereafter the mine can be translated rearwardly by movement of the endless drive member 42. As the mine reaches a predetermined point at or near the outboard end unit 24 a mechanism is provided for releasing the mine 46 from the carrier units 38, 40. The released mine falls along the path indicated by arrow 48 into the water 50. By installing the system 14 with the outboard end unit 24 extending beyond the transom 26 adequate separation between the ship 12 and the layed mine, shown in phantom 52, can be achieved by simply releasing the mine for a vertical drop from the moving ship 12. Greater separation from the ship 12 can be achieved by accelerating the drive member 42 so as to launch the mines 46 with a rearward velocity. The latter is the preferred launching method in high sea states. It is also the preferred method at high ship speeds, such as from hydrofoils or air cushion vehicles, when close spacing of the layed mines 52 is desired.

Figure 4:
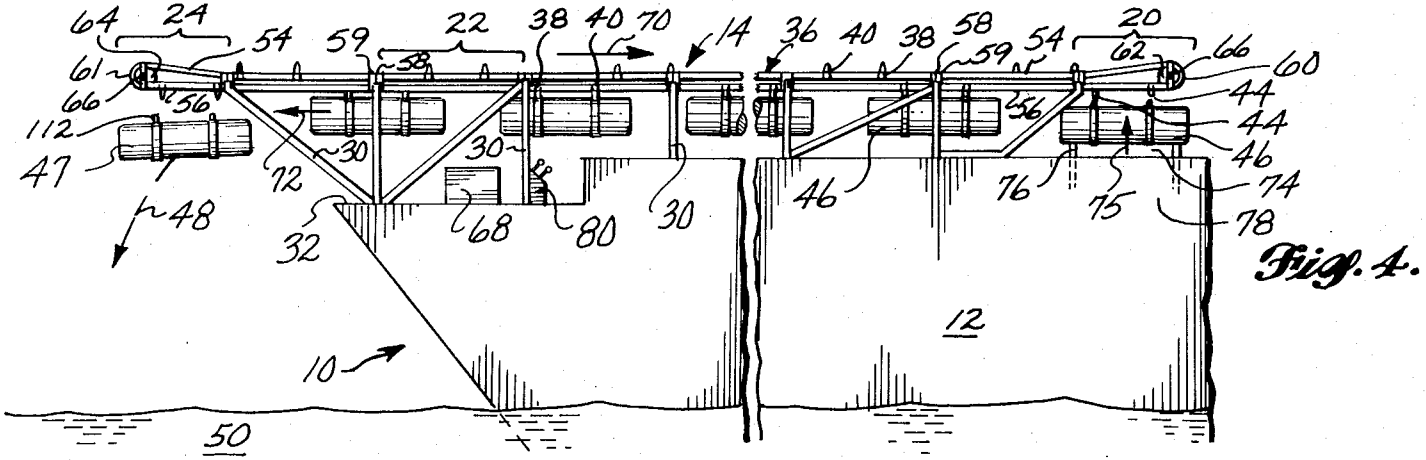
FIG. 4 is a slightly enlarged view of the aft portion of the ship depicted in FIG. 2 showing the modular construction of the minelaying system of the present invention.

Referring now to FIG. 4, the starboard rail system 14 is shown in more detail. A plurality of middle units 22 are coupled in longitudinal array between a pair of end sections 20, 24. Each middle unit 22 is framed by a horizontally disposed upper rail track 54 that is rigidly coupled in parallel to a horizontally disposed lower rail track 56 by a pair of vertically disposed connecting members 58, 59 at either end of the track sections 54, 56. A transversely disposed connecting beam 84, not shown in this view, spans the inner surfaces of the opposing connecting members 58, 58′ (59, 59′) at each end of the middle module 22. Each end unit 20, 24 also has a pair of connecting members 58, 58′ (59, 59′) that rigidly frame sections of upper and lower track 54, 56. In addition, the upper and lower track sections 54, 56 in each end section 20, 24 are developed at their distal ends into annular track sections 60, 61 that serve as turnabouts which confluently mate the two levels of track 54, 56 into a loop. Each end unit 20, 24 also has a roller 62, 64 that is pivotally mounted at the center of the turnabout 60, 61 by a shaft 66 that transversely spans an opposing pair of distal connecting members 57, 57′.

The minelaying system 14 is assembled by aligning the modules 20, 22, 24 in horizontal array and mechanically coupling the abutting surfaces of the connecting members 58, 59 that are disposed at the ends of each module 20, 22, 24. The rigid junctions between the abutting connecting members 58, 59 can be reinforced by coupling a stanchion 30 or other mounting member across the outer faces of each abutted pair of coupled members 58, 59. When the modules are coupled end to end the horizontal track components 54, 56 of the modules 20, 22, 24 are fixedly aligned by connecting members 58, 59 so that the track sections 54, 56 are mated to form an endless track system 36.

The minelaying system 14 is built up of ganged modular units 20, 22, 24 to obtain the length that can be accommodated by a particular craft of opportunity 12. The modules, constructed of the above-described framed track sections, preferably weigh approximately 200 pounds apiece. In one embodiment, the end units 20, 24 are each approximately six feet long, and the middle units 22 are each approximately 20 feet long. These dimensions and weights facilitate ease of handling and installation, such that an operational minelaying system 14 can be installed upon, or disassembled from, a ship 12 within about twenty-four hours or less.

As the minelaying system 14 is assembled on the ship 12, the wheels of a plurality of paired carrier assemblies 38, 40 are inserted into the open track sections 54, 56 before the track system 36 is closed into an endless loop. An endless drive member 42, not shown in this view, is looped about the rollers 62, 64, and the carrier assemblies 38, 40 are linked at spaced intervals to this drive member 42. A prime mover 68 generates hydraulic or electric power which is delivered to a hydraulic or electric motor, not shown, that is coupled to one of the rollers 62, 64, which serves as a drive roller; the other roller serves as an idler roller. In this embodiment, the prime mover 68 supplies power to a motor at the roller 64 in the outboard end unit 24. The motor rotates the drive roller 64, which circulates the drive member 42 along a flattened loop defined by the inboard and outboard rollers 62, 64 at the ends of the system 14. The linked carrier assemblies 38, 40 are pulled by the drive member 42 along a path of travel defined by the coincident rail system 36 to which the carriers 38, 40 are also associated.

The circuit shown by arrows 70, 72 indicates the path of travel of the drive member 42 and the linked carriers 38, 40 when the minelaying system is operated in a launching mode. A loading station 74 is located beneath the inboard end unit 20 of the system 14. A mine 46 is raised, as indicated by arrow 75, by a hydraulic lift, bomb hoist or other device 76, and engaged with the grasping members 44 on a pair of carriers 38, 40. The loaded mine 46 can then be translated beneath the system 14, along the longitudinal path indicated by arrow 72, to the outboard end section 24 for release along the path of arrow 48 into the water 50. The empty carriers 38, 40 are then moved by the endless drive member 42 through the outboard turnaround 61 for an inverted overhead return, by the path of arrow 70, to the inboard turnaround 60 and thence to the loading station 74. In this embodiment the ship 12 has sufficient capacity to carry an extra store of mines 46 in its hold 78, and so the minelaying system 14 can be reloaded at sea. In an alternative embodiment the inboard end 20 of the system 14 can be snaked into the hold 78 to a loading station 74 below the deck 32.

The prime mover 68 can be a diesel engine coupled either mechanically, electrically, or hydraulically to the drive roller gearbox, not shown. If mechanically coupled the prime mover 68 will be located close to and aligned with the drive roller gearbox. The electric or hydraulic power can alternatively be supplied by the ship's system, provided it can accept the additional load. The drive system can be programmed and remotely controlled to obtain the mine ejection speed and spacing desired. Depending upon the speed of the minelaying ship, and the desired spacing between layed mines 52, short intervals between mine drops may be required. For example, a mine spacing of 100 feet at a ship speed of 12 knots would require the launch of a mine every 4.9 seconds; at 25 knots, every 2.4 seconds. Such handling requirements can only be met by a powered system of sufficient rating to accelerate the mines to the drop position in the allotted time. The drive system can also be further accelerated to impart a rearward ejection velocity to the mine in order to assure adequate separation from the ship. A control system controls both the start of the drive system and its acceleration to a preselected belt speed for release or ejection of the mine(s). The control system can automatically stop the drive system when a mine is released and will provide emergency braking in the event of a malfunction. The start, speed selection, and braking controls are located in a control console 80 that can be placed adjacent to the system 14, and remote control of these functions from a sheltered area of the ship can also be provided.

Figure 6:
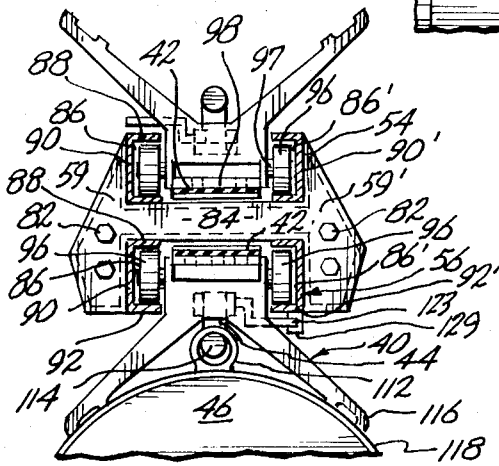
FIG. 6 is a cross-sectional view taken along section line 6—6 in FIG. 5.

Referring now to FIGS. 5 and 6 an outboard end unit 24 is shown attached to the distal end of a middle unit 22 in starboard minelaying system 14. The proximal, meaning toward the center of the system, surface of the connecting beam 59 at the proximal end of the end unit 24 is abutted against the distal, meaning away from the center of the system, surface of the connecting beam 58 at the distal end of middle unit 22. The abutted connecting beams 58, 59 are bolted together by longitudinally disposed fastening members 82 that pass through mated holes provided in the connecting beams 58, 59. The outer faces of connecting beams 58, 59 are beveled to provide two or more surfaces to which mounting supports can be attached. A plurality of holes or threaded holes are provided on these beveled outer faces to facilitate such attachments.

The endless track system 36 is framed by pairs of opposing connecting beams 58, 58' (59, 59') on the starboard and port sides, respectively, of minelaying system 14. Each such opposing pair of connecting beams is connected by a connecting rod 84 that is disposed in a plane perpendicular to the longitudinal axis of the system 14. The connecting beams 57, 57' that span the turnabouts 60, 61 in the end units 20, 24 are framed by the shafts 66 around which the rollers 62, 64 pivot.

The endless track system 36 consists of two side-by-side rail channels 86, 86' that open toward each other. Each of the channels 86, 86' has a U-shaped cross-section defined by an upper flange 88, a lateral web 90, and a bottom flange 92. It will be understood that, the track system 36 forming an endless loop, the lower flanges 92 on the upper rail track 54 are developed into the upper flanges 88 on the lower rail track 56 through proximally disposed flanges 94 in the turnabouts 60, 61. Similarly, the upper flanges 88 in the upper rail track 54 are mated to the lower flanges 92 in the lower rail track 56 through distally disposed flanges 95 in the turnabouts 60, 61. These two concentrically disposed bands composed of mated flanges define the vertical limits of the channels 86, 86' on either side of the track system 36. The vertically and outwardly disposed webs 90, 90' that interconnect the two above-described flange systems define the lateral limits of the channels 86, 86'

Wheels 96 rotatably attach to transversely disposed axles 97 on the carrier units 38, 40 ride in the channels 86, 86' along the looped track system 36 defined by the above-described flanges and webs. The opposing channels 86, 86' open toward each other and embrace the wheels 96 of the carrier assemblies 38, 40. The play of the wheels 96 within the channels 86, 86' is kept small in order to restrict lateral movements of the carriers 38, 40 and grasped mines 46. The wheels 96 can be provided with an antifriction coating, not shown, on their outward surfaces that face the webs 90. The periodically spaced connecting members 57, 58, 59 brace the webs 90 and flanges 88, 92 and so serve to preserve the complimentary alignment of the opposing channels 86, 86' and prevent any deformation of the track system 36 as the grasped mines 46 are translated along the system 14.

Due to the small play of the wheels 96 within the channels 86, 86', a gate, not shown, is preferably introduced into the track 54, 56 in order to facilitate the insertion of the wheels 96 of the carriers 38, 40 into the loop of the rail system 36. A drive member 42, such as the toothed transmission belt shown in FIG. 5, is looped into the circuit and connected with a splice 104 as described below. Adjustable tension devices, not shown, are employed to achieve an operative tensioning of the drive member 42 such that the teeth 106 of the belt 42 are cooperatively engaged between the teeth 108 of the drive and idler rollers 62, 64. The drive member 42 can be a toothed belt, a flat belt, a roller chain, a steel cable, or some other suitable member. A toothed belt is preferred because it advantageously requires a minimum bending radius, is relatively lightweight, requires no lubrication, and has a low noise level in an operating system.

Each carrier unit 38, 40 is linked to the endless drive member 42 by one or more suitable attachment devices 98 which also serve to minimize the diameters of the rollers 62, 64 and turnabouts 60, 61. For example, a row of threaded studs or bolts disposed transversely across the drive member 42 can comprise a suitable attachment device 98, as described below.

Each carrier unit 38, 40 has an enlarged footprint plate 110 that abuts against the outer surface of the toothed belt 42 and thereby increases the longitudinal rigidity of the grasped mines 46. A grasping member 44 depends from each carrier unit 38, 40. Since most mines 46 are equipped with a pair of aircraft configuration lifting eyes 112, the terminal end of the grasping member 44 is preferably drawn into a hook 114. Pairs of carriers 38, 40 are linked to the drive belt 42 at spaced intervals that correspond to the distance between the two lifting eyes 112 on the mine 46. The linked pairs of carriers 38, 40 are positioned along the belt 42 at intervals sufficient to accommodate the overall lengths of adjacently grasped mines 46. A mine 46 is loaded onto the minelaying system 14 by bringing the mine 46 into contact with a pair of linked carrier units 38, 40 such that the hooks 114 on the grasping members 44 can be inserted through the two lifting eyes 112 on the mine 46. The mine 46 is thereby hung suspended from the system 14. A pair of transverse legs 116 splay downward from each carrier 38, 40 to embrace either side of the upper mine housing 118 and so act as sway braces to restrain lateral movement, of the hooked mine 46.

Each grasping member 44 is pivotally mounted by a pin 120 that transversely spans the carrier assembly 38, 40 above the origin of the transverse legs 116. A trigger bar 122, 123 is attached transversely to the proximal side of the shank 124 of each hooked grasping device 44. The trigger bars 122, 123 extend laterally to underly the lower track 56 on opposite sides of the system 14. The paired carrier assemblies 38, 40 are selected and linked to the drive belt 42 such that their trigger bars 122, 123 extend outwardly on opposite sides of the system 14. In this particular embodiment 14, the trigger bar 122 on the distal carrier 38 extends outwardly to underlie the lower track 56 on the starboard side while the trigger bar 123 on the proximal carrier 40 extends outwardly to underlie the lower track 56 on the port side.

The grasped mine 42 is translated under the system 14 from the loading station 74, not shown in FIG. 5 or 6, to the launching station 126 on the outboard end unit 24. A pair of stops 128, 129 depend on either side of the system 14 from the lower flanges 92 of the lower track 56. The stops 128, 129 are fastened to the lower track 56 at an interval that corresponds to the distance between the trigger bars 122, 123 on the paired carrier units 38, 40. The stops 128, 129 are fastened to opposite sides 92, 92' of the lower track 56. As a translated mine 46 reaches the launching station 126 the trigger bars 122, 123 strike the stops 128, 129 in tandem, causing the grasping members 44 to pivot back on pins 120, thereby disengaging the hooks 114 from the lifting eyes 112. The disengaged mine 47 falls into the water 50, not shown in these views. Geared trigger mechanisms can alternatively be coupled between trigger bars 122, 123 and hooks 114 to effect release of the mine 46 from the grasping members 44. When the mine falls it is unsafetied and armed by its lanyards being pulled away; the fixed ends of the lanyards, not shown, are secured to one of the carriers 38, 40. The stops 128, 129 can be adjustably positioned under the lower track 56 so that simultaneous or slightly staggered, e.g., if a nose-first fall of the mine 46 is required, disengagements of the grasping members 44 occur.

Figure 7:
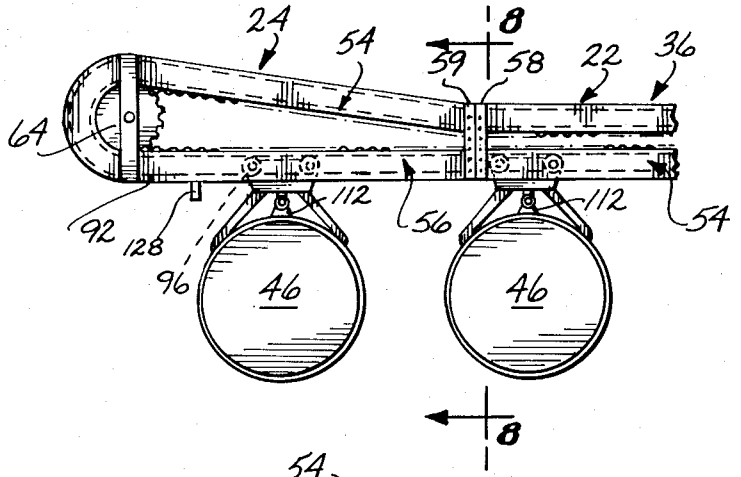
FIG. 7 is a side view of another embodiment of the present invention in which the mines are carried parallel to one another and transverse to the longitudinal axis of the system.
Figure 8:
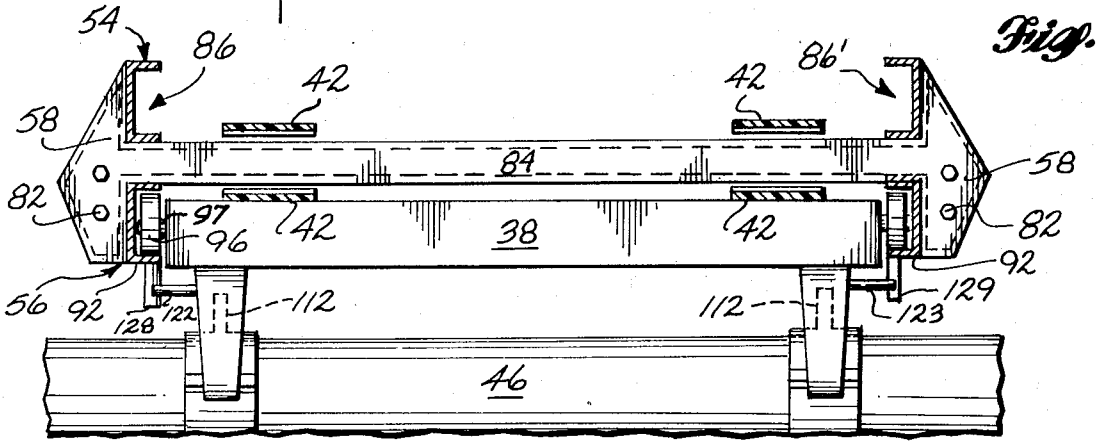
FIG. 8 is a cross-sectional view taken along section line 8—8 in FIG. 7.

Referring now to FIGS. 7 and 8 the mines 46 can alternatively be carried parallel to one another, transverse to the endless track system 36. Here a pair of transversely mounted mines 46 is suspended from the lower track 56 of an outboard end unit 24 that is coupled to abutting middle unit 22. The transversely disposed connecting rods 84 are elongated to accommodate the carrier assemblies 38, one of which is provided for each mine. Each carrier assembly 38 has four wheels 96, two of which ride in each of the opposing track channels 86, 86'. A pair of endless drive members 42, and paired rollers 62, 64 (one of which is indicated in FIG. 7), are employed. Stops 128, 129 are affixed at corresponding points on each lower flange 92 of the lower track 56. Outwardly extending trigger bars 122, 123 on each carrier unit 38 will strike the stops 128, 129 simultaneously, which striking effects release of the transversely carried mine 46 via a cammed trigger mechanism, not shown. In FIGS. 7 and 8, the empty carrier assemblies 38, 40 that circulate along the upper track 54 are not shown.

Figure 9:
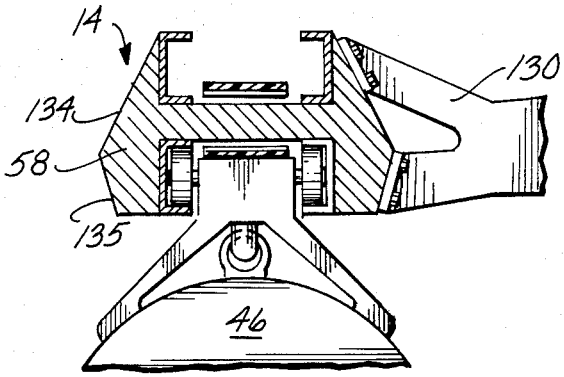
FIG. 9 is a section similar to FIG. 6 of a module mounted by lateral supports to, e.g., a gunwale.
Figure 10:
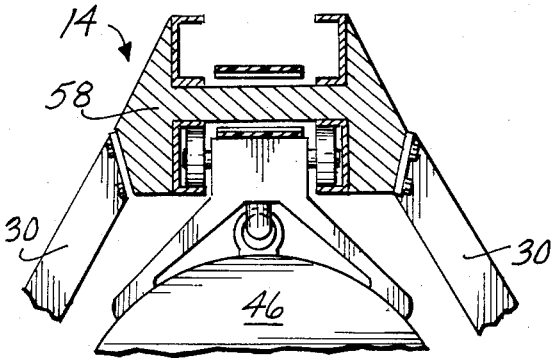
FIG. 10 is a section of a module mounted on stanchions to, e.g., a deck.
Figure 11:
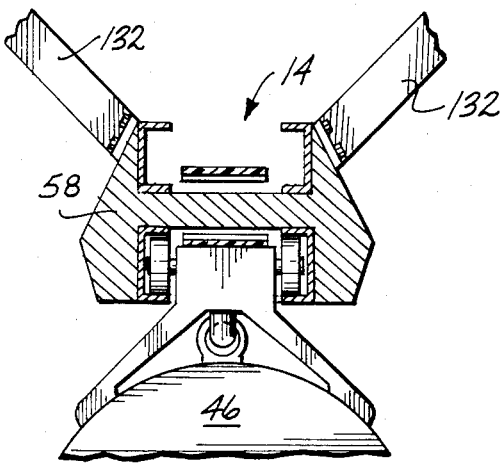
FIG. 11 is a section of a module suspended by overhead hangers from, e.g., a ship's superstructure.

Referring now to FIGS. 9, 10 and 11, the minelaying system 14 can be mounted to a ship 12 in various ways: by outrigger braces 130 (FIG. 9) from either gunwale for an outboard installation; on stanchions 30 (FIG. 10) from a deck; or from overhead hangers 132 (FIG. 11). The minelaying system 14 can be advantageously adapted to different ships without changing the hardware of the system; only the mounting supports, e.g., 30, 130, 132, need be adapted to fit the specific configuration of each ship. The adaptability of the minelaying system is enhanced by the beveled outer surfaces 134, 135 of the connecting members 57, 58, 59. For example, one beveled surface 134 can be inclined outwardly and upwardly, and another surface 135 can be inclined outwardly and toward the deck.

Figure 12:
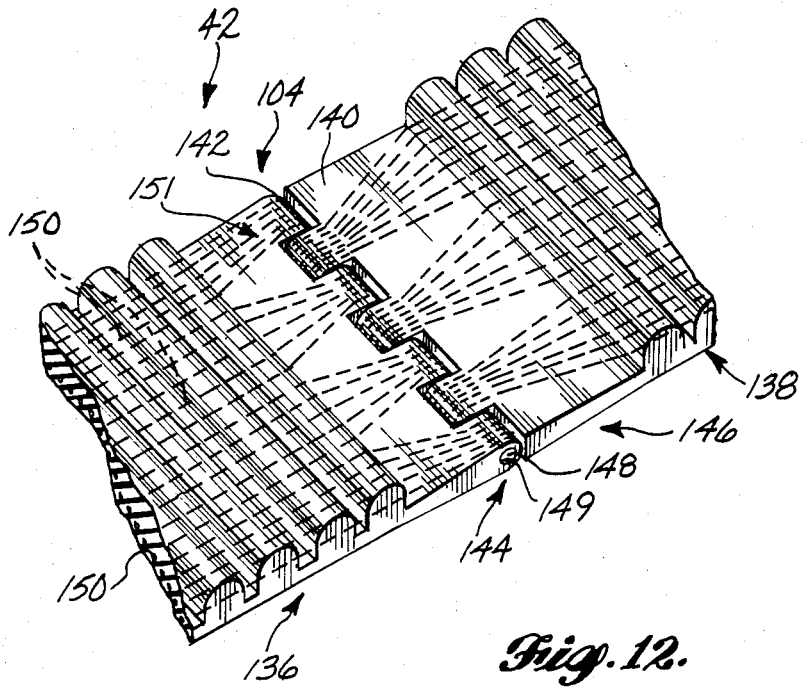
FIG. 12 is an isometric view of a belt splice used in the practice of the present invention.
Figure 13:
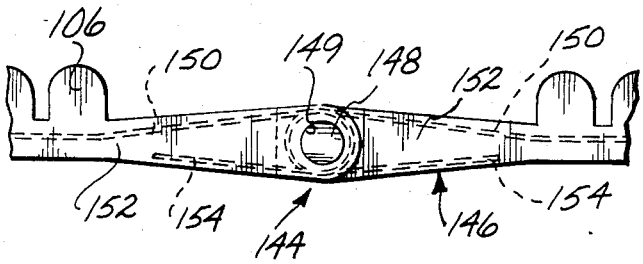
FIG. 13 is a side elevation view of the belt splice of FIG. 12.

Referring now to FIGS. 12 and 13 a novel belt splice 104 is shown whereby the sections 136, 138 of endless drive member 42 can be ganged together to form an endless loop, the circumference of which will be dictated by the number of modules 20, 22, 24 assembled together to form the minelaying system on a particular craft of opportunity. This minelaying system is a building block system that is designed to be quickly assembled in different lengths. Consequently the toothed belt 42 (or other drive member) must also come in sections. A vulcanized splicing of the belt 42 is possible but is not preferred because it requires time and specialized, heavy equipment. It is preferable to make a splice that is easy to connect and disconnect in the field. For example, the toothed drive belt 42 can be spliced with a novel belt splice 104 of the present invention. This splice 104 is formed by engaging complementary series of male and female tongues 140, 142 at the abutting ends 144, 146 of the belt sections 136, 138 to be spliced. A connecting pin 148 is then inserted through a hinge bore 149 that passes transversely through the engaged tongues 140, 142. This splice 104 further provides for an advantageous load transfer between the abutting ends 144, 146 of the belt sections 136, 138 because the longitudinally arrayed tension cords 150 within the body 152 of each section 136, 138 are not cut. Instead, the tension cords 150 are gathered together into bundles 151 near the ends 144, 146 of the belt segments 136, 138, the bundles 151 are wrapped around the hinge bores 149 in the tongues 140, 142. Each tension cord 150 is preferably formed into an endless loop that is stretched between the hinge bores 149 at each end of a belt section. Alternatively, the tension cords 150 in open lengths can be brought back to anchor points 154 in the rubber body 152. The latter method requires a more complicated manufacturing process for proper preloading of the cords 150.

With the connecting pin 148 inserted through the hinge bore 149 a direct load path between all of the tension cords 150 in the abutting belt sections 136, 138 is achieved. Since any cutting of the tension cords 150 would reduce the belt strength this splice 104, in which all of the tension cords 150 are aligned with and grouped around the connecting pin 148, maximizes the load transfer. Such belt sections 136, 138 can be manufactured in various lengths, with complementary series of male or female tongues 140, 142 at opposite ends, and then mechanically joined together in the field to accommodate the circumference of the endless drive member 42 to the assembled minelaying system 14 on the craft of opportunity 12.

Figure 14:
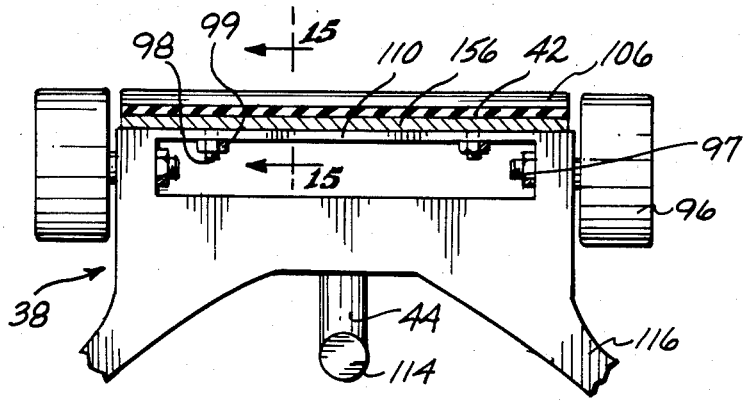
FIG. 14 is a section that shows an attachment device for linking a nonexpendable carrier assembly to an endless drive belt.
Figure 15:
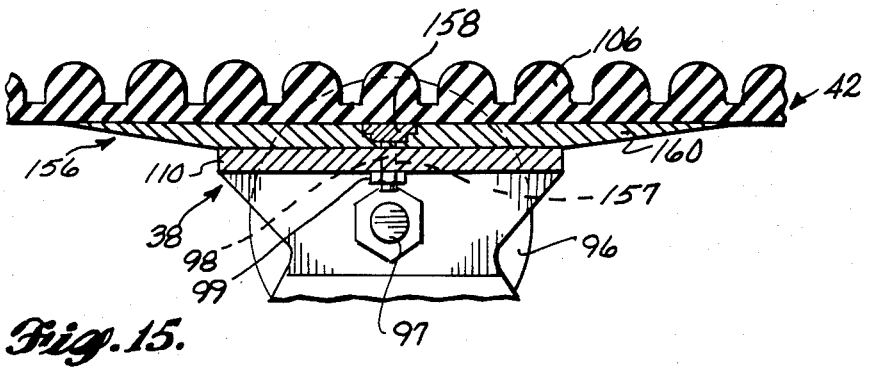
FIG. 15 is a cross-sectional view taken along section line 15—15 in FIG. 14.
Figure 16:
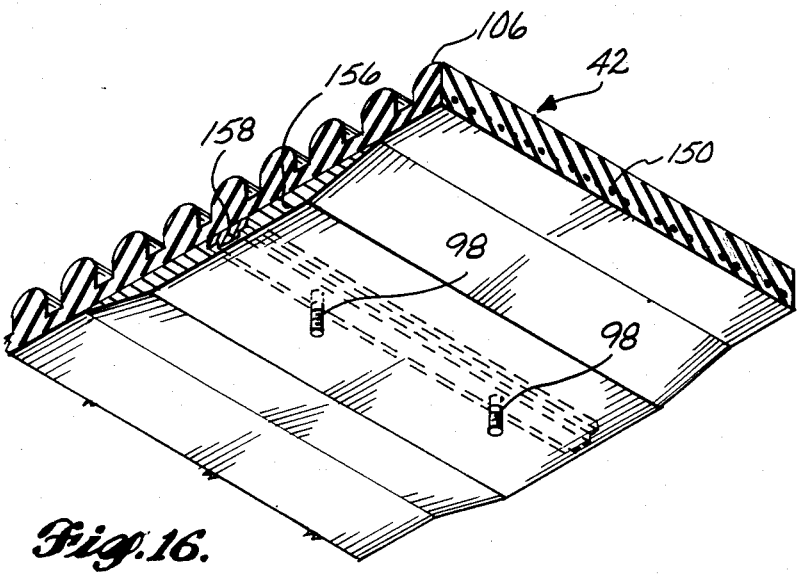
FIG. 16 is an isometric view of the attachment device shown in FIGS. 14 and 15 viewing the inside of the belt.

An example of an attachment device 98 for linking carrier assemblies 38, 40 to the endless drive member 42 is shown in FIGS. 14, 15, and 16. Referring first to FIG. 14, a two-wheeled carrier 38 is linked to a toothed transmission belt 42 by a pair of threaded studs 98 that are spaced transversely across the belt 42 in line with the axles 97 of the wheels 96 and extend perpendicularly outwardly from the surface of the belt 42. The studs 98 are anchored in an elastomeric member 156 that is bonded to the outwardly facing surface of the belt 42, on the side opposite the teeth 106. The threaded free ends of the studs 98 extend through holes 157 in the footprint plate 110 of the carrier assembly 38 that abuts against the belt 42 and are secured by nuts 99.

Referring now to FIGS. 15 and 16, the studs 98 can be permanently affixed to a cross bar 158 that is embedded in the elastomeric member 156. The studs 98 and cross bar 158 can be metallic, in which case they can be welded together. Alternatively, the studs 98 and cross bar 158 can be integrally molded out of resin or fiberglass. The elastomeric member 156 that contains the embedded cross bar 158 is bonded or vulcanized to the outwardly facing surface of the drive belt 42. To strengthen the bond while maintaining longitudinal rigidity of the grasped mines and the small bending radius of the belt 42, the edges 160 of the elastomeric member 156 can be tapered toward the belt surface in the direction of the belt on both sides of the footprint 110.

Figure 17:
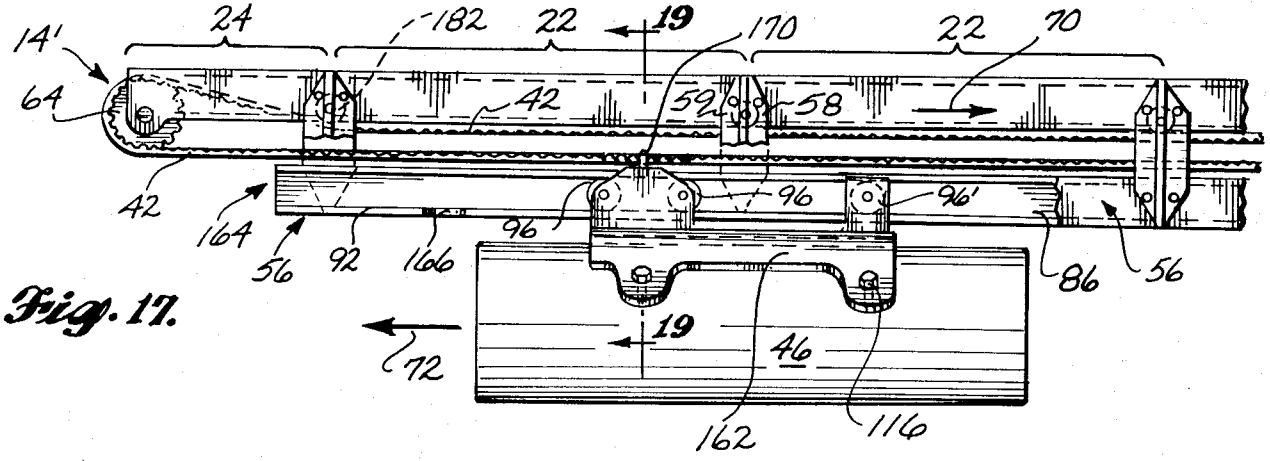
FIG. 17 is a side view of the terminal end of another embodiment of the present invention in which each mine is attached to an expendable carrier that is deployed along with the released mine.
Figure 18:
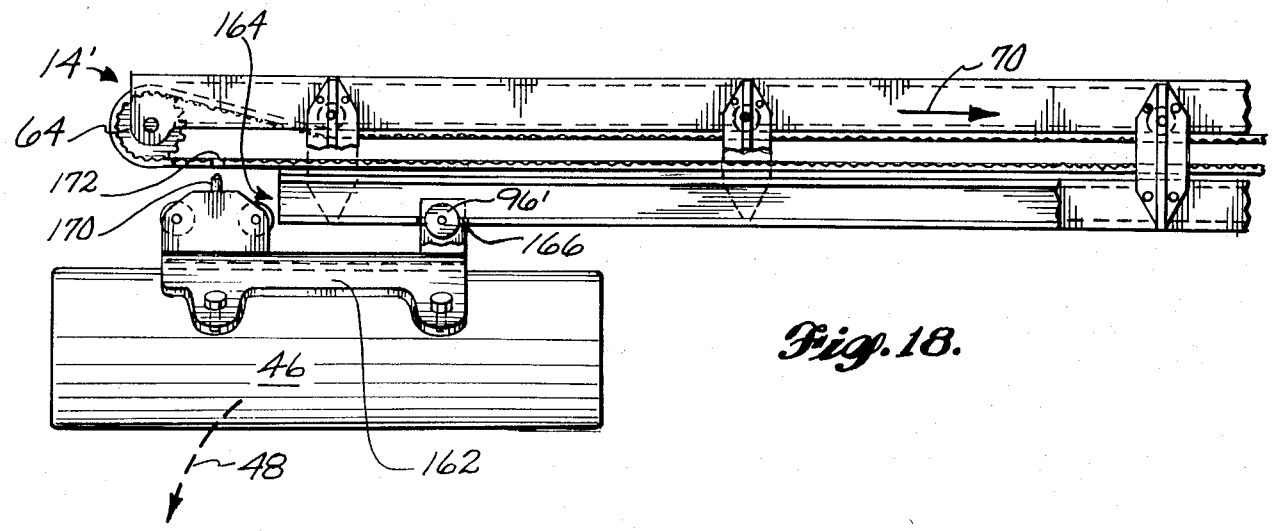
FIG. 18 is a view similar to FIG. 17, but showing the deployment of a mine attached to an expendable carrier.
Figure 19:
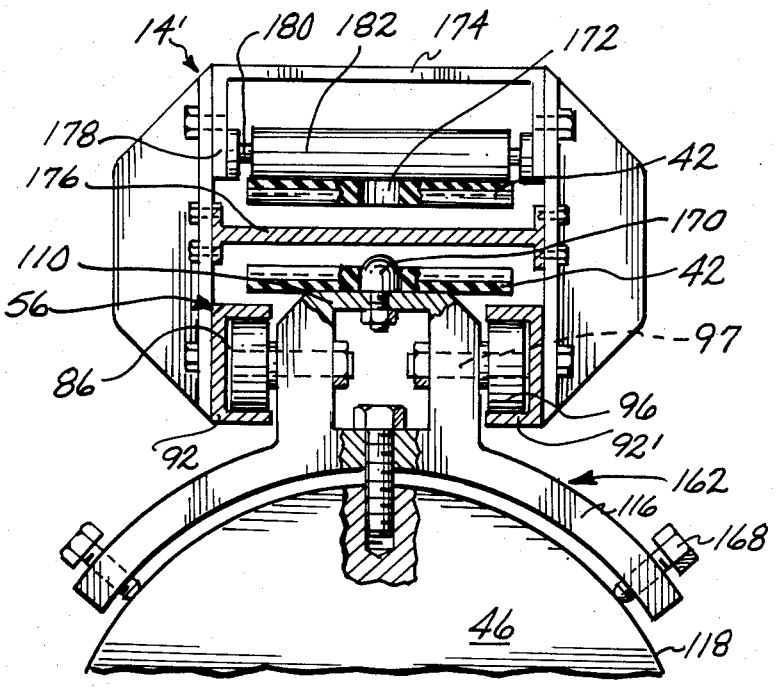
FIG. 19 is a section taken along section line 19—19 in FIG. 17.

The present invention can also be practiced with expendable carriers 162 that are attached to and deployed with the released mines 46, as illustrated in FIGS. 17, 18, and 19. In FIG. 17 a mine 46 attached to an expendable carrier 162 is translated along the path indicated by arrow 72 beneath a minelaying system 14' of the present invention. In this embodiment the minelaying system 14' has a horizontally disposed lower rail track 56 that coincides with the lower longitudinal axis of the system. The rail track 56 is framed by vertical connecting members 58, 59 and transverse connecting members, not shown in this view. Like the above-described embodiments this minelaying system 14' is modularized, being composed of a plurality of middle units 22 coupled between an outboard end section 24 and an inboard end section 20, not shown. The modules 20, 22, 24 are coupled by bolting together the abutting surfaces of the vertically disposed connecting members 58, 59 at the ends of each module 20, 22, 24. A drive roller 64 and an idler roller 62, not shown, are disposed at either end of the system 14', and an endless drive member 42 is looped about the rollers 62, 64.

Unlike the above-described embodiments that employ nonexpendable carriers 38, 40, this embodiment 14' does not have an endless track system 36. Only a lower rail track 56 is required when expendable carriers 162 are employed; no turnarounds 60, 61 or upper rail track 54 are necessary. The lower rail track 56 extends the length of the system 14', from a loading station 74, not shown, near the inboard end section 20, not shown, to a terminus 164 near the outboard end section 24. At the terminus 164, the opposing channels 86, 86' of the track 56 open abruptly into space. A cutout 166 is provided in the lower flanges 92, 92' of the track 56 at a spaced interval proximal to the terminus 164. The length of the cutout 166 is slightly greater than the diameter of the wheels 96, 96' on the carrier 162, and the spaced interval from the cutout 166 to the terminus 164 is slightly less than the distance between the axles 97 of the trailing wheels 96' and the closest leading wheel 96.

An expendable carrier 162 is permanently attached to each mine 46, e.g., by bolting the carrier 162 to two existing threaded holes in the mine 46, before the carrier is introduced into the lower rail track 56 at the loading station 74. In this embodiment two pairs of transverse legs 116 splay downward from the expendable carrier 162 to embrace either side of the upper mine housing 118 and so act as sway braces to restrain lateral movements of the attached mine 46. Alternatively a single pair of transverse legs 116 can be disposed near the midpoint of the expendable carrier 162. Adjustable devices 168 at the outer ends of the transverse legs 116 serve to accommodate mines 46 of different diameters.

Each expendable carrier 162 has three pairs of wheels 96, 96' that are embraced by the opposing channels 86, 86' of the lower rail track 56. The outboard, leading end of the expendable carrier 162 is fitted with two pairs of wheels 96, while the inboard, trailing end of the carrier 162 is fitted with a single pair of wheels 96'. A drive pin 170 extends upwards from the center of the carrier between the leading pairs of wheels 96. The drive pin 170 is passed through a spaced hole 172 at the centerline of the drive belt 42 as the expendable carrier 162 (with mine 46 attached) is inserted into the lower rail track 56 at the loading station 74. As the drive member 42 is circulated in the direction of arrow 70 the reversibly engaged drive pin 170 pulls the wheeled expendable carrier 162 with attached mine 46 along the lower rail track 56, along the path indicated by arrow 72, toward the outboard end unit 24.

Referring now to FIG. 18 as the carrier 162 approaches the terminus 164 the dual set of lead wheels 96 permits the outboard end of the carrier 162 to straddle and pass over the cutout 166. The single pair of trailing wheels 96', however, fall through the cutout 166 just as the proximal pair of leading wheels 96 pass beyond the terminus 164 of the track 56. No longer supported by the rail track 56, the expendable carrier 162 with attached mine 46 then falls along the path indicated by arrow 48 as the drive pin 170 disengages from the hole 172 in the drive belt 42. The fixed ends of the lanyards, not shown, that unsafety and arm the mine 46 upon its release from the system 14' are attached to the outward side of the drive belt 42 near the hole 172 in which the drive pin 170 of the carrier 162 is reversibly engaged.

Referring now to FIG. 19, the aforementioned transverse connecting members consist of top beams 174 and a separating plate 176. The top beams 174 are bolted between opposing pairs of vertical connecting members 58, 59 at the ends of each module 20, 22, 24. The top beams 174 have vertically disposed flanges 178 that house the axle 180 of a guide roller 182 that transversely spans the upper part of the system 14'. The guide rollers 182 serve to guide and tension the drive belt 42 on its return journey from the outboard end unit 24 to the inboard end unit 20. The separating plate 176 is a continuous sheet that runs the length of the system 14' and prevents the lanyards from becoming entangled with the lower components of the system 14'.

Referring now to FIGS. 20, 21, and 22, another embodiment of the minelaying system 14' is shown wherein the expendable carriers 162 with attached mines 46 are disposed transversely with respect to the longitudinal axis of the system 14'. Two drive belts 42 are provided, and paired drive rollers 64 and idler rollers 62, not shown, are employed. Here no cutout 166 need be provided in the lower rail track 56, as the trailing pair of wheels 96' of the carriers 162 are simply pulled beyond the terminus 164 by a pair of drive pins 170 that pass through coincidentally registered holes 172 in the synchronized drive belts 42.

While the present invention has been described in conjunction with preferred embodiments, one of ordinary skill after reading the foregoing specification will be able to effect various changes, substitutions of equivalents, and other alterations to the devices set forth herein. It is therefore intended that the protection granted by letters patents hereon be limited only by the definition contained in the appended claims and equivalents thereof.

The embodiments of the invention in which an exclusive property or privilege is claimed are defined as follows:

1. A device for laying mines from a ship comprising:

a frame member with first and second ends, said frame member having a rail track framed by vertical and transverse connecting members;

means for mounting said frame member to the ship;

an endless drive member with a drive roller and an idler roller disposed in opposite ends of said frame member, said endless drive member looped about said rollers;

a plurality of carriers engaged at spaced locations to said endless drive member, said carriers having wheels that are retained within the rail track and having grasping means for selectively grasping a mine; and means for releasing each mine from the minelaying device at a predetermined point along its transit beneath the frame member.

2. A device as in claim 1, wherein said rail track forms an endless loop.

3. A device as in claim 2, wherein said releasing means causes said grasping means to release each mine from its carrier.

4. A device as in claim 1, wherein said rail track defines the lower longitudinal axis of said frame member.

5. A device as in claim 4, wherein said releasing means causes each carrier along with its grasped mine to be released from the minelaying system.

6. A device as in claim 1, wherein said vertical connecting members have beveled outward surfaces to which said mounting means are mechanically coupled.

7. A device as in claim 1, wherein said endless drive member is a toothed belt.

8. A device as in claim 1, wherein said frame member comprises a plurality of midsection modules coupled between two end modules, one of which contains the drive roller and the other the idler roller.

9. A device as in claim 1, wherein said endless drive member comprises a plurality of spliced sections.

10. A device as in claim 1, wherein said frame member is mounted generally parallel to the keel of the ship.

11. A device as claimed in claim 10, wherein the mounting means comprise stanchions fixed to the ship's deck and to the frame member.

12. A device as in claim 10, wherein the mounting means comprise overhead hangers fixed to a suitable ship's overhead structure and to the frame member.

13. A device as in claim 10, wherein the mounting means comprise outrigger braces fixed to the ship's gunwales and to the frame member.

14. A device as in claim 1, wherein said frame member is mounted generally parallel to the beam of the ship.

15. A device as in claim 14, wherein the mounting means comprise stanchions fixed to the ship's deck and to the frame member.

16. A device as in claim 14, wherein the mounting means comprise overhead hangers fixed to a suitable ship's overhead structure and to the frame member.

17. A device as in claim 1, wherein the mines are carried parallel to the longitudinal axis of said frame member.

18. A device as in claim 1, wherein the mines are carried perpendicular to the longitudinal axis of said frame member.

* * * * *

UNITED STATES PATENT AND TRADEMARK OFFICE

CERTIFICATE OF CORRECTION

PATENT NO. : 4,633,778

DATED : January 6, 1987

INVENTOR(S) : Joner et al.

It is certified that error appears in the above-identified patent and that said Letters Patent is hereby corrected as shown below:

Figures 20, 21 and 22 should be added as per attached sheet.
"18 Claims, 19 Drawing Figures" should read --18 Claims, 22 Drawing Figures--

Signed and Sealed this

Ninth Day of February, 1988

*Attest:*

DONALD J. QUIGG

*Attesting Officer*

*Commissioner of Patents and Trademarks*

Fig. 20.
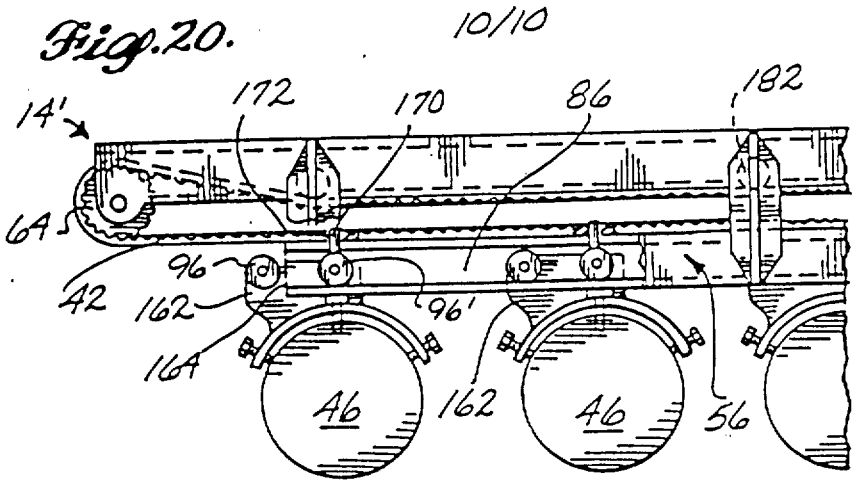
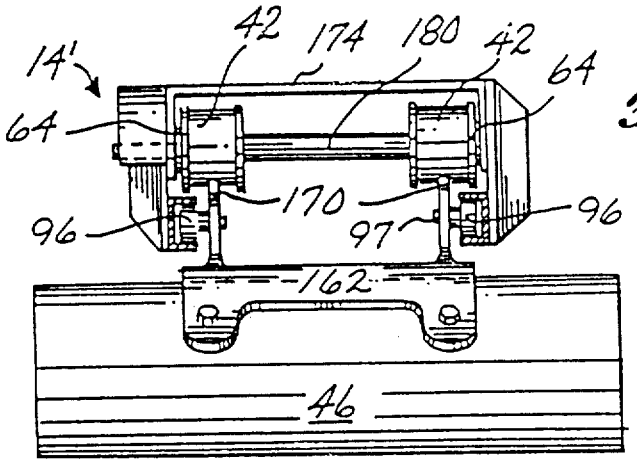
Fig. 21.
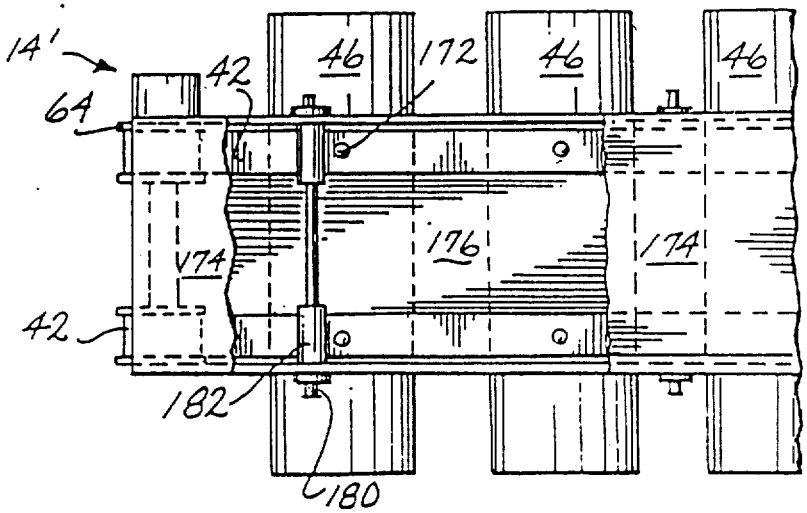
Fig. 22